US009339940B2

(12) United States Patent
Pelton

(10) Patent No.: US 9,339,940 B2
(45) Date of Patent: May 17, 2016

(54) SURVIVAL KNIFE WITH INTEGRATED MOVEABLE GUARD

(71) Applicant: DPX VENTURES LIMITED, Ras Al Khaimah (AE)

(72) Inventor: Robert Young Pelton, Bonsall (CA)

(73) Assignee: DPX VENTURES LIMITED, Ras Al Khaimah (AE)

( * ) Notice: Subject to any disclaimer, the term of this patent is extended or adjusted under 35 U.S.C. 154(b) by 63 days.

(21) Appl. No.: 14/154,046

(22) Filed: Jan. 13, 2014

(65) Prior Publication Data

US 2015/0197022 A1 Jul. 16, 2015

(51) Int. Cl.
*B26B 29/02* (2006.01)
*B26B 11/00* (2006.01)

(52) U.S. Cl.
CPC ..... *B26B 29/025* (2013.01); *B26B 11/00* (2013.01); *B26B 29/02* (2013.01)

(58) Field of Classification Search
CPC ..... B26B 11/00; B26B 29/02; B26B 29/025
See application file for complete search history.

(56) References Cited

U.S. PATENT DOCUMENTS

D229,472 S 12/1973 Collins
D270,655 S 9/1983 Collins
4,442,559 A * 4/1984 Collins ..... B26B 3/06 30/153
4,546,510 A 10/1985 Harrison
4,607,432 A 8/1986 Montgomery
D306,687 S * 3/1990 Inman ..... D8/105
D322,019 S * 12/1991 Cox ..... D8/14
D336,232 S 6/1993 Thompson et al.
D422,190 S 4/2000 Zaha
D464,511 S 10/2002 Clarke et al.
D464,551 S 10/2002 Glesser
6,594,906 B1 * 7/2003 Sakai ..... B26B 1/046 30/155
6,658,743 B2 * 12/2003 Dudley, Jr. ..... B26B 3/00 30/314
7,051,443 B2 5/2006 Mueller
D548,814 S * 8/2007 Fuller ..... D22/118
7,325,312 B1 2/2008 Janich
D566,222 S 4/2008 Hawk et al.
D611,320 S * 3/2010 Jeandupeux ..... D8/105
D634,174 S * 3/2011 Ryan ..... D8/99
7,941,928 B2 * 5/2011 Fisher ..... B26B 13/22 30/254
8,079,148 B2 * 12/2011 Chao ..... B23D 51/03 30/155

(Continued)

OTHER PUBLICATIONS

Camillus Dominator Carbonitride Titanium Fixed Blade Knife, retrieved from www.amazon.com on Feb. 10, 2014, 3 pages.

*Primary Examiner* — Hwei C Payer
(74) *Attorney, Agent, or Firm* — ARC IP Law, PC; Joseph J. Mayo

(57) ABSTRACT

A survival knife with integrated moveable guard that may move from a first position that provides a guard for the blade to a second position that provides half of the handle portion of the knife. Embodiments may include a carabiner coupled with the body of the knife and tools integrated into the blade or body.

17 Claims, 11 Drawing Sheets

(56) References Cited

U.S. PATENT DOCUMENTS

| | | | | |
|---|---|---|---|---|
| 8,117,754 | B2 * | 2/2012 | Lion | B24D 15/084 30/138 |
| 8,322,039 | B2 * | 12/2012 | De Buyer-Mimeure | B26B 25/005 30/123 |
| D699,315 | S | 2/2014 | Seeds et al. | |
| 8,707,490 | B1 * | 4/2014 | Pelton | B26B 1/00 30/123 |
| 2006/0277762 | A1 * | 12/2006 | Knight | B26B 1/02 30/153 |
| 2007/0283575 | A1 | 12/2007 | Hix et al. | |
| 2012/0272534 | A1 * | 11/2012 | Lee | B26B 11/00 30/298.4 |
| 2013/0167381 | A1 * | 7/2013 | Kommer | B26B 1/044 30/161 |
| 2013/0185943 | A1 | 7/2013 | Landwehr | |
| 2014/0250694 | A1 * | 9/2014 | Constantine | B26B 29/02 30/153 |
| 2014/0345144 | A1 * | 11/2014 | Frazer | B26B 3/00 30/153 |
| 2015/0197022 | A1 * | 7/2015 | Pelton | B26B 29/025 30/153 |

* cited by examiner

SURVIVAL KNIFE WITH INTEGRATED MOVEABLE GUARD

BACKGROUND OF THE INVENTION

1. Field of the Invention

One or more embodiments of the invention are related to the field of knives. More particularly, but not by way of limitation, embodiments of the invention implement a survival knife with integrated moveable guard that may move from a first position that provides a guard for the blade to a second position that provides half of the handle portion of the knife Embodiments may be constructed from materials that can withstand hostile environments.

2. Description of the Related Art

Standard knives generally include a long, yet thin blade with a handle. The blade generally includes one cutting edge, and an opposing non-cutting edge. Some knives have cutting edges on both sides of the blade. Knives also are built in folding varieties and generally have a pivot on one or both ends of the handle. However, most knives are non-folding and have one cutting edge. Folding knives are generally more portable and tend to enclose the sharp cutting edge of the knife when folded for safety reasons. Some folding knives include multiple types of blades including saws, can openers, screw drivers, and other tools, but generally only provide one function per blade or only provide cutting blades that have no other function.

Modern survival knives are limited in the number of functions they provide since the number of elements utilized to create a survival knife is limited to a blade, optionally with serrations and a handle. There are no known survival knives that include a single robust blade for example a wide blade that may be struck from above and utilized as a wedge to split wood, etc., with structural elements on the single blade, or coupled to the blade, including an integrated moveable guard, and that may also include integrated tools, such as a hex nut driver and lashing points.

For example, U.S. Pat. No. 7,325,312 to Janich, entitled "Folding Knife With Pivoting Blade and Guard", appears to disclose a folding knife with a handle, pivoting blade guard and a pivot blade, wherein the guard and blade pivot are secured to or within a handle. Janich also appears to disclose a tang pin that serves as a stop for the handle and the guard to limit a range of rotation. Janich, however, appears to lack any disclosure of a body coupled with the blade that forms a first half of a handle to engage a palm of a user, and a guard that covers a cutting edge in a first position and forms a second half of the handle to engage fingers of the user in a second position on an opposing side of the first half of the handle. In addition, Janich appears to lack any disclosure of a survival knife with an integrated tool including, for example, one or more of a carabiner and a wrench tool to enable rotation of multiple sizes of nuts.

US Publication 20070283575 to Hix et al., entitled "Pull-Type, Handle-Held Package Opened With Pivoting Blade Guard", appears to disclose a hand-held pull-cut tool for opening over-packaging enclosures that may encapsulate smaller products, using a pivoting blade guard to remove such enclosures. Hix et al., however, appears to lack any disclosure of a body coupled with the blade that forms a first half of a handle to engage a palm of a user, and a guard that covers a cutting edge in a first position and forms a second half of the handle to engage fingers of the user in a second position on an opposing side of the first half of the handle. In addition, Hix et al. appears to lack any disclosure of a survival knife with an integrated tool including, for example, one or more of a carabiner and a wrench tool to enable rotation of multiple sizes of nuts. For example, US Publication 20130185943 to Landwehr, entitled "Hand Cutter With Blade Guard", appears to disclose a hand cutter with a blade guard that provides protection from accidental cutting and may be activated from a locked position by a trigger, by closing around a cutter handle. Landwehr also appears to disclose wherein the release blade guard remains released until the blade has been used, and the blade guard release is removed such that the guard is automatically relocked when the guard returns to an original position. Landwehr, however, appears to lack any disclosure of a body coupled with the blade that forms a first half of a handle to engage a palm of a user, and a guard that covers a cutting edge in a first position and forms a second half of the handle to engage fingers of the user in a second position on an opposing side of the first half of the handle. In addition, Landwehr appears to lack any disclosure of a survival knife with an integrated tool including, for example, one or more of a carabiner and a wrench tool to enable rotation of multiple sizes of nuts.

Generally, survivalists and military personnel in hostile or hazardous environment carry a multitude of other tools along with a survival knife, generally in a sheath or in a folding format. In minimalistic survival scenarios, carrying a multitude of tools is not possible. In such hostile environments, life may depend on having a survival tool such as a knife that is robust and capable of performing other functions. For at least the limitations described above there is a need for a survival knife with integrated moveable guard.

BRIEF SUMMARY OF THE INVENTION

One or more embodiments described in the specification are related to a survival knife with integrated moveable guard. Embodiments of the invention implement a survival knife with integrated moveable guard that may move from a first position that may provide a guard for the blade, to a second position that may provide half of the handle portion of the knife. Embodiments of the invention may include a knife blade that is highly durable with a thick top cross section. This thick top may enable the blade to endure being struck when using the knife blade as a wood splitting wedge. In at least one embodiment of the invention, the blade may include a front portion and two substantially flat faces, and a top edge. In embodiments of the invention, the blade may include a cutting edge on a first side of the blade where the two substantially flat faces may meet, wherein the top edge may be located on a second side of the blade opposite the cutting edge. In embodiments, the top may be flat and may be at least 3/16 of an inch wide or wider.

According to embodiments of the invention, the survival knife may include one or more of a body that may be coupled with the blade, and a guard that may be coupled with the body. In one or more embodiments, the body may include a rear portion and may form an upper first half of a handle that may engage a palm of a user. In embodiments of the invention, the guard may cover the cutting edge in a first position, and when moved away from the cutting edge of the blade, may form a lower second half of the handle. As such, the guard may engage fingers of the user in a second position on an opposing side of the first half of the handle.

By way of one or more embodiments, the guard may be rotationally coupled with the body at approximately half way between the front portion of the blade and the rear portion of the body. In at least one embodiment, the body may include one or more of a cam, a lock cam pin indentation and a lock. In one or more embodiments, the lock may include one or more of a lock cam pin, a lock pin, a lock arm coupled with the lock cam pin and the lock pin, and a spring that may be coupled with the guard and the lock. In at least one embodiment, the spring may provide increased force as the lock is extended from the guard. In embodiments of the invention, the cam may one or more of move the lock cam pin, the lock arm and the lock pin toward the front portion of the blade, and move the lock pin past the front portion of the blade above the cutting edge as the guard is rotated into the first position to cover the cutting edge of the blade.

In one or more embodiments of the invention, the lock cam pin indentation may one or more of move the lock cam pin, the lock arm and the lock pin toward the rear portion of the body as the lock cam pin enters the lock cam pin indentation, and thus move the lock pin, via the lock arm, above the cutting edge to lock the lock pin against the top edge of the blade. In at least one embodiment, the lock arm may move the lock cam pin, the lock arm and the lock pin toward the front portion of the blade as the lock cam pin exits the lock cam pin indentation, and the lock arm is rotated down. In embodiments of the invention, the lock arm may move the lock pin below the cutting edge to unlock the lock pin from against the top edge of the blade and enable the guard to rotate to the second position to form the second half of the handle.

The blade, in at least one embodiment, may include jimping on the top edge of the blade. In one or more embodiments, the body may include jimping on a portion of the first half of the handle formed by the body. In one or more embodiments, the jimping may include slots on the top of the blade near the handle, and/or on the back of the body of the blade, that may enable thumb contact with the blade that may provide better control of the knife.

By way of one or more embodiments, the body may include a finger hole, and the guard may include a curved surface that may provide an ergonomic grip to the fingers of the user. In embodiments of the invention, the body may include a carabiner that may open and close via a gate. In one or more embodiments, the blade may include a wrench tool that may enable rotation of multiple sizes of nuts. By way of one or more embodiments, the blade may include an optional indent that may engage the lock pin.

According to one or more embodiments, the survival knife with integrated moveable guard may include one or more hexagonal holes on the blade, of the same size and shape or of various sizes and shapes, to enable the blade to be used as an integrated tool, such as a hex nut tool for various hex nut sizes. In embodiments, the blade may include a single hexagonal hole to enable the blade to be used for a single hex nut size. As such, the one or more hexagonal holes enable the knife to be utilized as a hex nut wrench. The hex nut integrated tool, in one or more embodiments, may be located in the center of the blade, in the front portion of the blade, or at the rear portion of the blade away from a front portion tip. As such, the integrated tool may be used when the knife is in the open, closed, or half open configuration. When used with the knife closed, e.g., with the guard safely covering the blade, then the user's fingers may grip the front portion of the knife without injury from the cutting edge. This may provide more torque to the integrated tool. In one or more embodiments, the integrated tool may be magnetized to hold bits.

In at least one embodiment, the knife, or the integrated tool, may include lashing points that may be located on the blade. In embodiments of the invention, the lashing points may be located on the knife or blade that does not comprise strength. By way of one or more embodiments, the integrated tool, the one or more hexagonal holes, the jimping, or any combination thereof may be used to lash the knife to another object.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A survival knife with integrated moveable guard will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
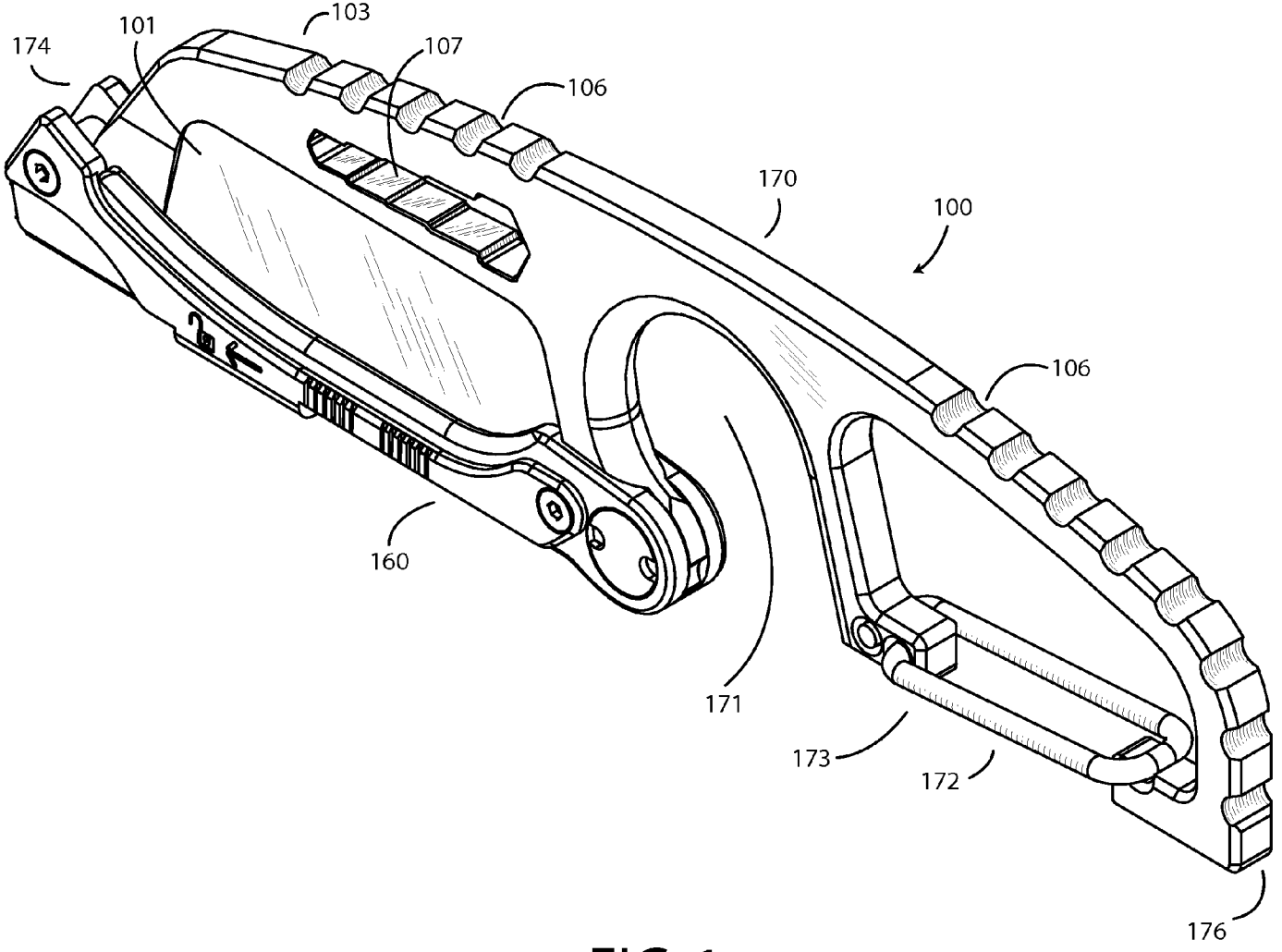
FIG. 1 illustrates an upper perspective embodiment of the invention in the closed position.
Figure 2:
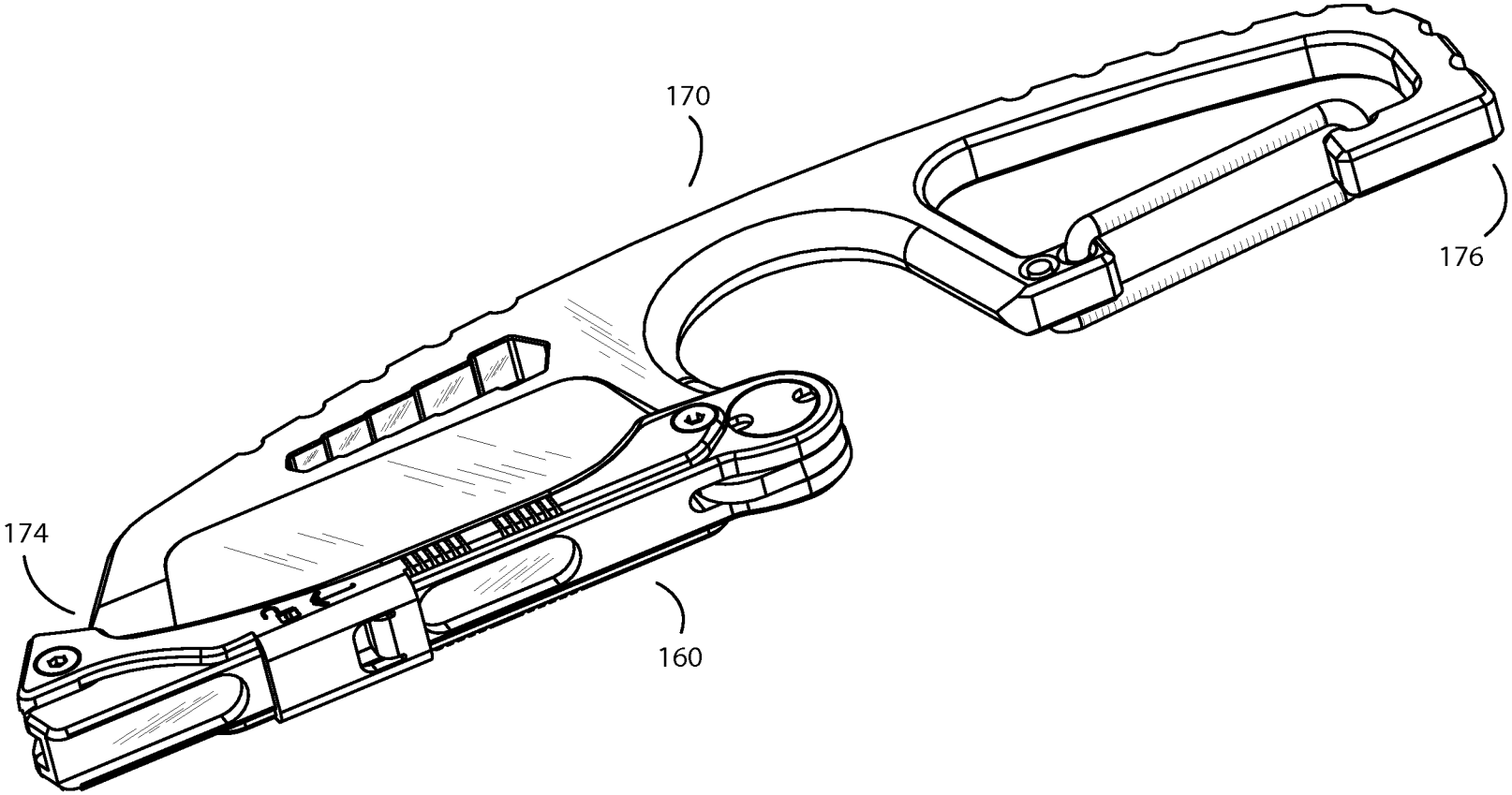
FIG. 2 illustrates a lower perspective embodiment of the invention in the closed position.

One or more embodiments described in the specification are related to a survival knife with integrated moveable guard. FIG. 1 illustrates an upper perspective embodiment of the invention in the closed position, and FIG. 2 illustrates a lower perspective embodiment of the invention in the closed position. Embodiments of the invention implement a survival knife 100 with integrated moveable guard that may move from a first position that may provide a guard 160 for a blade 101 to a second position that may provide half of the handle portion of the knife 100. As shown in FIGS. 1-2, the survival knife 100 may include one or more of a front portion or tip 174, a rear portion 176 and body 170. In at least one embodiment, the survival knife 100 may include one or more of the blade 101, a non-cutting edge 103, jimping 106, an integrated tool 107, such as a multi-size hex nut wrench tool, a wire gate 172, a carabiner 173 to clip the knife to other objects by rotating wire gate 172 inward and hooking the knife to another object wherein the wire gate 172 provides force to close the carabiner with spring force generated by each end portion of the wire gate housed in a laterally displaced hole as shown to provide biasing torque to force the wire gate to the plane in which the two holes lie, a finger hole 171 and the guard 160.

Figure 3:
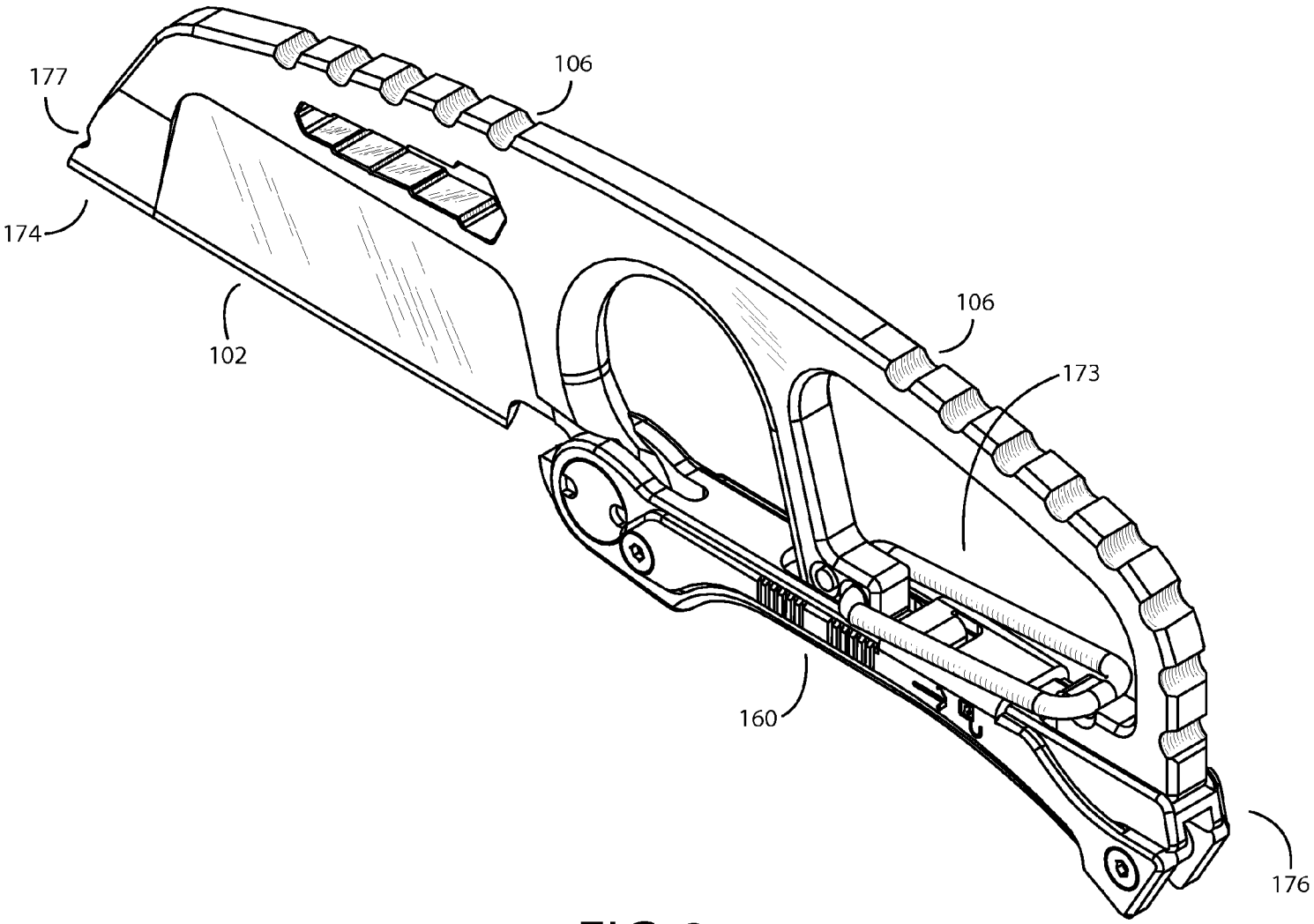
FIG. 3 illustrates an upper perspective embodiment of the invention in the open position.
Figure 4:
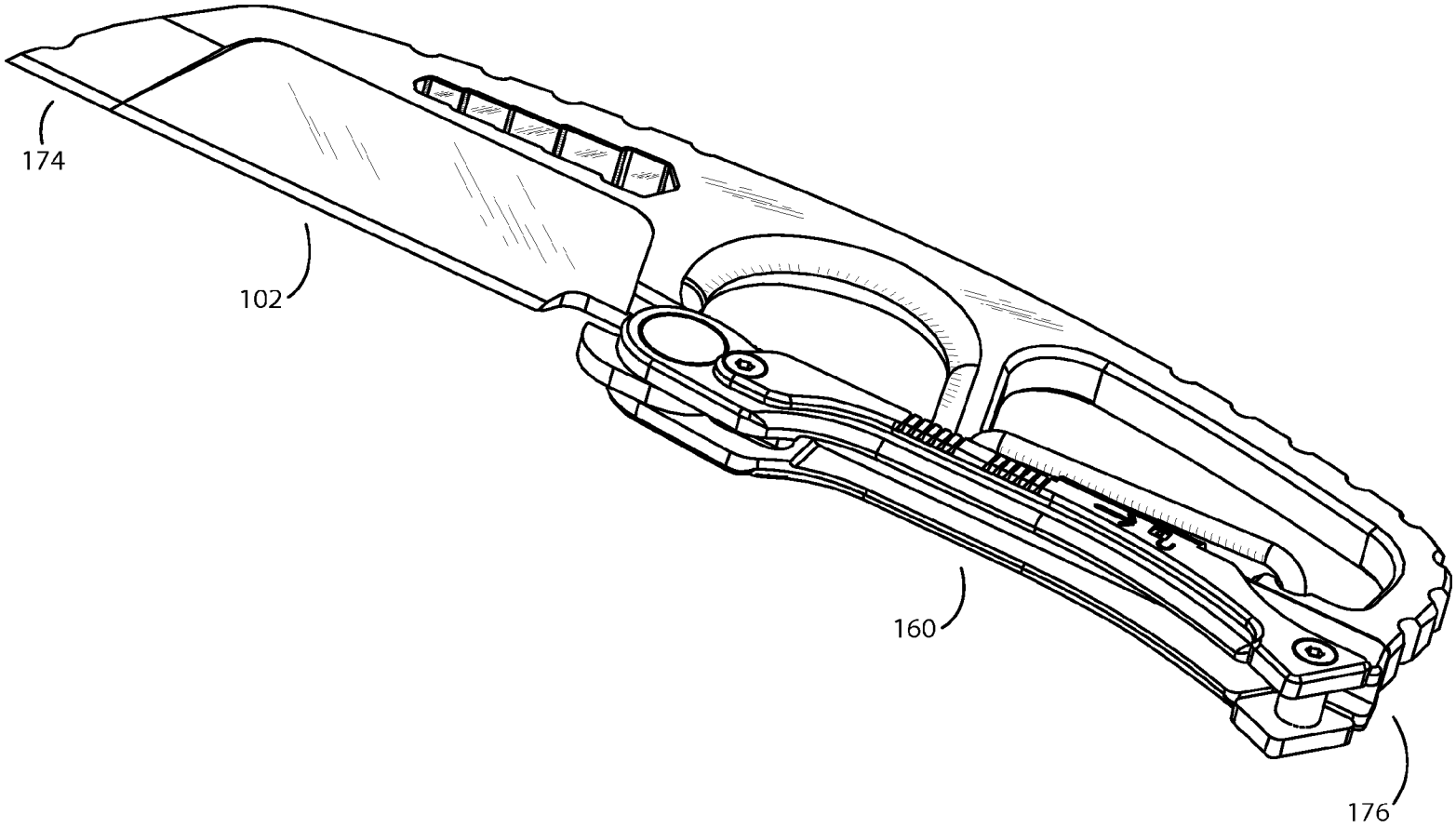
FIG. 4 illustrates a lower perspective embodiment of the invention in the open position.

FIG. 3 illustrates an upper perspective embodiment of the invention in the open position, and FIG. 4 illustrates a lower perspective embodiment of the invention in the open position. As shown in FIGS. 3-4, the guard 160 is in an open position, after moving from the closed position about the front portion or tip 174 shown in FIGS. 1-2, to the open position about the rear portion 176. In addition to the front portion or tip 174, the rear portion 176, body 170, the non-cutting edge 103, the jimping 106, the wrench tool 107, the wire gate 172, the carabiner 173, the finger hole 171 and the guard 160, in one or more embodiments, the survival knife 100 may include one or more of an optional indent 177 and a cutting edge 102. In at least one embodiment, the cutting edge 102 is located at an opposite side facing, and/or in some embodiments parallel to, the non-cutting edge 103 of the blade 101. Embodiments of the invention may include the knife blade 101 that is highly durable with a thick top cross section. This thick top may enable the blade 101 to endure being struck when using the knife blade 101 as a wood splitting wedge.

Figure 5A:
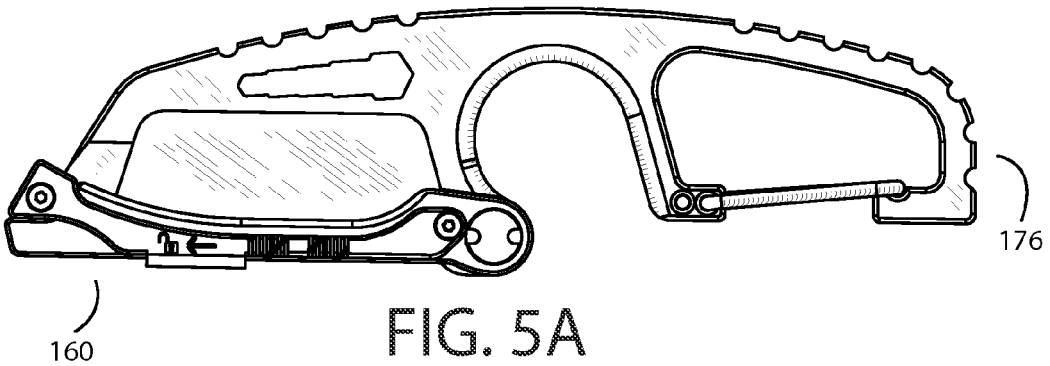
FIG. 5A illustrates a left side perspective embodiment of the invention in the closed position.
Figure 5B:
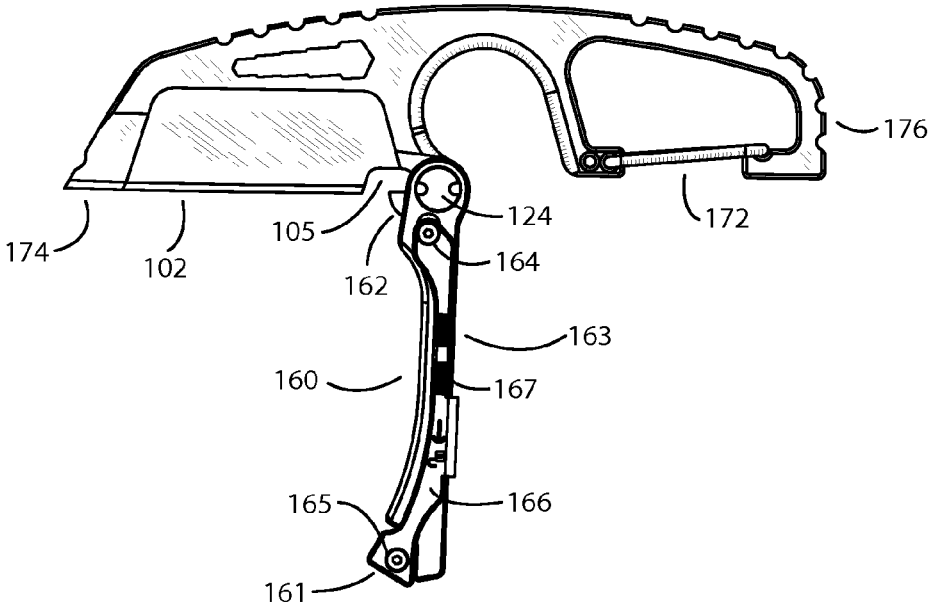
FIG. 5B illustrates a left side perspective embodiment of the invention in the half open position.
Figure 5C:
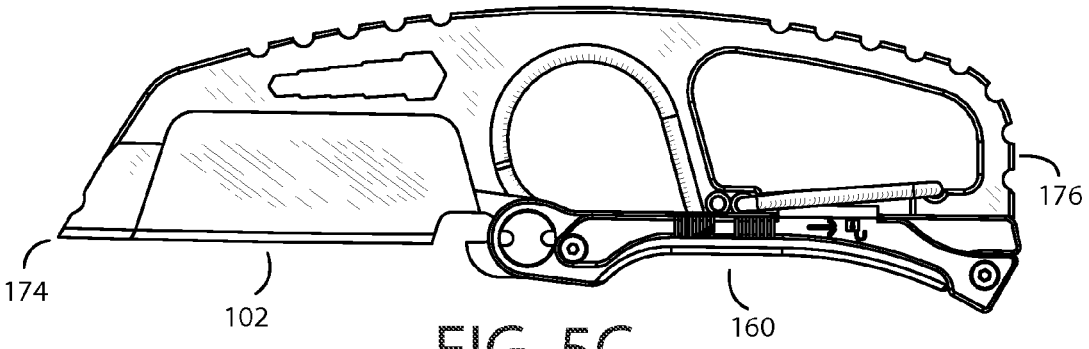
FIG. 5C illustrates a left side perspective embodiment of the invention in the open position.

FIG. 5A illustrates a left side perspective embodiment of the invention in the closed position, FIG. 5B illustrates a left side perspective embodiment of the invention in the half open position and FIG. 5C illustrates a left side perspective embodiment of the invention in the open position. The right side views are mirror images and are not shown for brevity. As shown in FIGS. 5A-5C, one or more embodiments of the invention implement the survival knife 100 with integrated moveable guard that may move from the first position or closed position (as shown in FIG. 5A), to a half open position (as shown in FIG. 5B), and to a second position or closed position that may provide half of the handle portion of the survival knife 100 (as shown in FIG. 5C). In at least one embodiment of the invention, the blade 101 may include the front portion or tip 174, two substantially flat faces, and a top edge. In one or more embodiments of the invention, the blade 101 may include the cutting edge 102 on a first side of the blade 101 where the two substantially flat faces may meet, and the non-cutting edge 103, wherein the top edge may be located on a second side of the blade 101 opposite the cutting edge 102. In embodiments, the top may be flat and may be at least 3/16 of an inch wide.

According to one or more embodiments of the invention, the survival knife 100 may include one or more of the body 170 that may be coupled with the blade 101, and the guard 160 that may be coupled with the body 170. In one or more embodiments, the body 170 may include the rear portion 176 and may form a first half of a handle that may engage a palm of a user. In embodiments of the invention, the guard 160 may cover the cutting edge 102 in a first position, and may form a second half of the handle as shown in FIG. 5C. As such, the guard 160 may engage fingers of the user in a second position on an opposing side of the first half of the handle.

Figure 10:
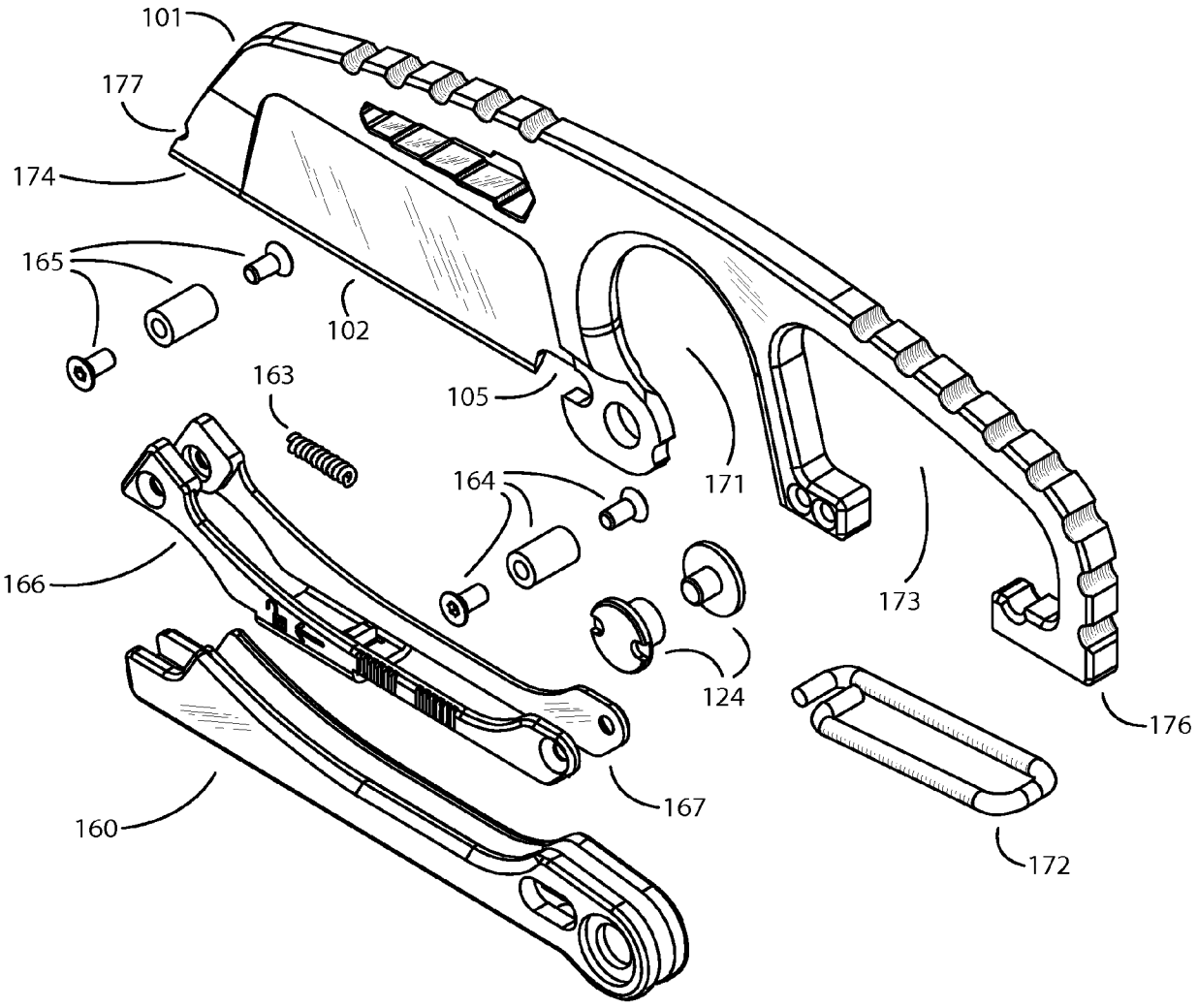
FIG. 10 illustrates an exploded view of the invention with a cutter blade according to one or more embodiments.

By way of one or more embodiments, the guard 160 may be rotationally coupled with the body 170 at approximately half way between the front portion or tip 174 of the blade 101, or body 170, and the rear portion 176 of the body 170. In FIG. 5B, the survival knife 100 is shown in the half open position, wherein the guard 160 may be rotated to an angle of 90 degrees away from the front portion or tip 174 and/or the rear portion 176. To open or close the knife, the guard 160 may be moved to and past a half open position, e.g., that is almost substantially perpendicular to the cutting edge 102. In at least one embodiment, the body 170 may include one or more of a cam 162, a lock cam pin indentation 105, and a lock 161. In one or more embodiments, the lock 161 may include one or more of a lock cam pin 164, a lock pin 165, a lock arm 166 coupled with the lock cam pin 164 and the lock pin 165, and a spring 163 (as shown in FIG. 10) that may be coupled with the guard 160 and the lock 161. In at least one embodiment, the spring 163 may provide increased force as the lock 161 is extended from the guard 160. In embodiments of the invention, the cam 162 may move the lock cam pin 164, the lock arm 166 and the lock pin 165 toward the front portion 174 of the blade 101, and/or may move the lock pin 165 past the front portion 174 of the blade 101 above the cutting edge 102 as the guard 160 is rotated into the first position to cover the cutting edge 102 of the blade 101, as shown in FIG. 5A.

In one or more embodiments of the invention, the lock cam pin indentation 105 may move the lock cam pin 164, the lock arm 166 and the lock pin 165 toward the rear portion 176 of the body 170 as the lock cam pin 164 enters the lock cam pin indentation 105 as shown in FIG. 5A, and/or may move the lock pin 165 above the cutting edge 102 to lock the lock pin 165 against the front portion of the blade 101. In at least one embodiment, the lock arm 166 may move the lock cam pin 164, the lock arm 166, and the lock pin 165 toward the front portion 174 of the blade 101 as the lock cam pin 164 exits the lock cam pin indentation 105. In one or more embodiments of the invention, the lock arm 166 may move the lock pin 165 outward past the tip of the knife to unlock the lock pin 165 from against the front portion of the blade 101, then below the cutting edge 102, and enable the guard 160 to rotate to the second position to form the second half of the handle.

The blade 101, in at least one embodiment, may include jimping 106 on the top edge of the blade 101. In one or more embodiments, the body 170 may include jimping 106 on a portion of the first half of the handle formed by the body 170. By way of at least one embodiment of the invention, the jimping 106 may include slots on the top of the blade 101 near the handle, and/or on the back of the body of the blade 101, that may enable thumb contact with the blade 101 that may provide better control of the knife 100.

According to one or more embodiments, the body 170 may include a finger hole 171, and the guard 160 may include one or more of a curved surface that may provide an ergonomic grip, or lock grip, 167, to the fingers of the user, and a pivot bolt 124. In embodiments of the invention, the body 170 may include the carabiner 173 that may open and close via the gate 172, such as a wire gate. In one or more embodiments, the blade 101 may include the wrench tool 107 that may enable rotation of multiple sizes of nuts. By way of one or more embodiments, the blade 101 may include the optional indent 177 that may engage the lock pin 165.

According to one or more embodiments, the survival knife 100 with integrated moveable guard may include one or more hexagonal holes on the blade 101, of the same size and shape or of various sizes and shapes, to enable the blade 101 to be used as an integrated tool, such as a hex nut tool for various hex nut sizes. In at least one embodiment of the invention, the blade 101 may include a single hexagonal hole to enable the blade 101 to be used for a single hex nut size. As such, the one or more hexagonal holes enable the knife 100 to be utilized as a hex nut wrench. The hex nut integrated tool, in one or more embodiments, may be located in the center of the blade 101, in the front portion of the blade 174, or at the rear portion 176 of the body 170 away from a front portion tip. As such, the integrated tool may be used when the knife 100 is in the open, closed, or half open configuration. In one or more embodiments, the integrated tool, knife 100 or blade 101 may be magnetized to hold bits.

In at least one embodiment, the knife 100, or the integrated tool, may include lashing points that may be located on the blade 101. In embodiments of the invention, the lashing points may be located on the knife 100 or blade 101 that does not comprise strength. By way of one or more embodiments, the integrated tool, the one or more hexagonal holes, the jimping 106, or any combination thereof may be used to lash the knife 100 to another object.

Figure 6A:
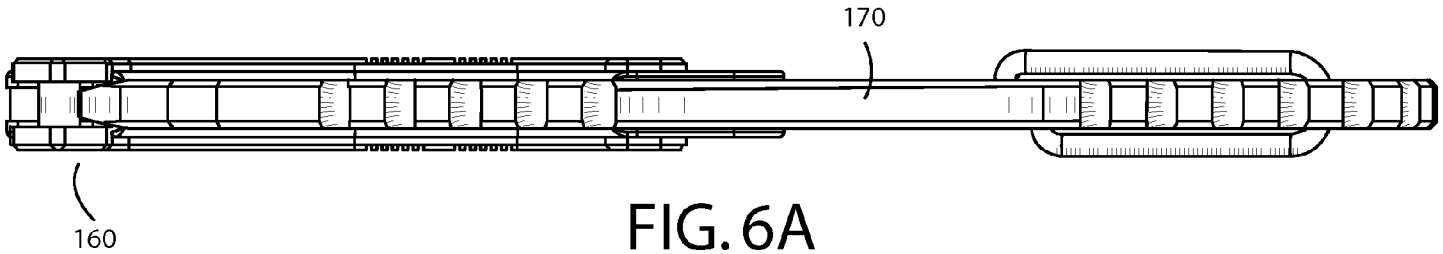
FIG. 6A illustrates a top perspective embodiment of the invention in the closed position.
Figure 6B:
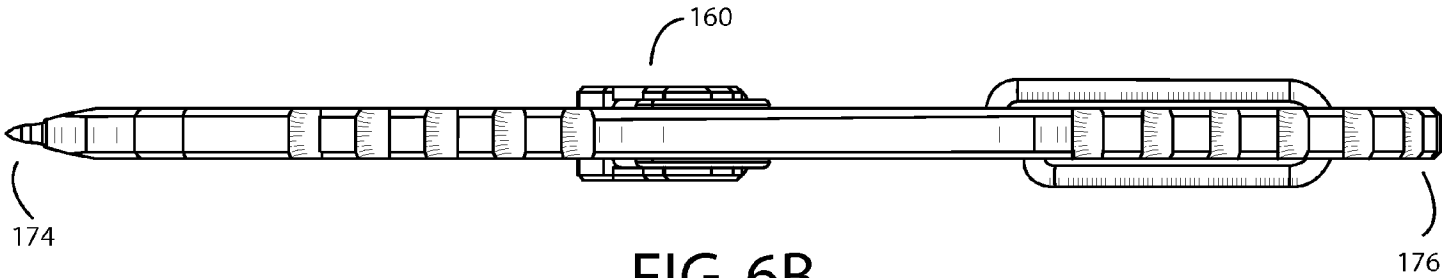
FIG. 6B illustrates a top perspective embodiment of the invention in the half open position.
Figure 6C:
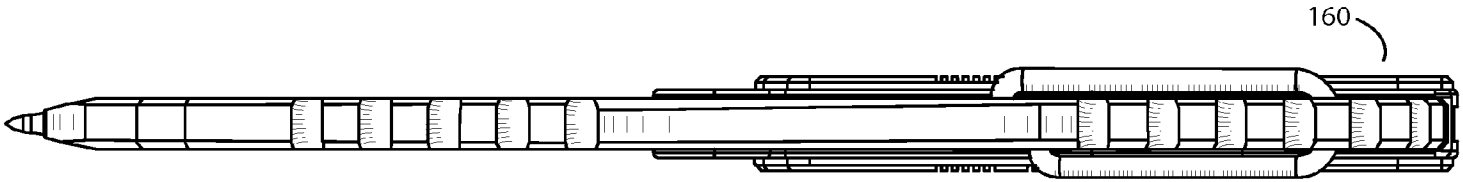
FIG. 6C illustrates a top perspective embodiment of the invention in the open position.

FIG. 6A illustrates a top perspective embodiment of the invention in the closed position, FIG. 6B illustrates a top perspective embodiment of the invention in the half open position, and FIG. 6C illustrates a top perspective embodiment of the invention in the open position. As shown in FIGS. 6A-6C, one or more embodiments of the invention may include the survival knife with the body 170, the front portion or tip 174 of the blade and the rear portion 176 of the blade. By way of one or more embodiments, in the first position, or closed position, the guard 160 may be located about the front portion or tip 174 of the blade 101 as shown in FIG. 6A. In at least one embodiment, the half open position, the guard 160 may be located beneath the center portion the blade 101, between the front portion or tip 174 and the rear portion 176, as shown in FIG. 6B. According to one or more embodiments, in a second position, or open position, the guard 160 may be located about the rear portion 176, of the blade 101 as shown in FIG. 6C.

Figure 7A:
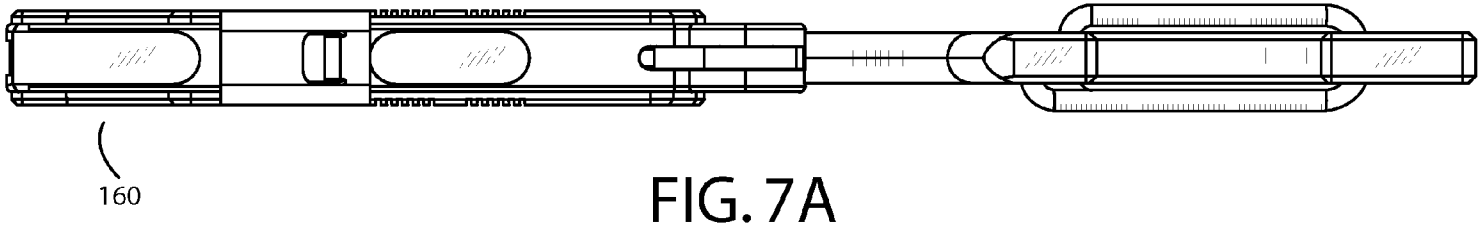
FIG. 7A illustrates a bottom perspective embodiment of the invention in the closed position.
Figure 7B:
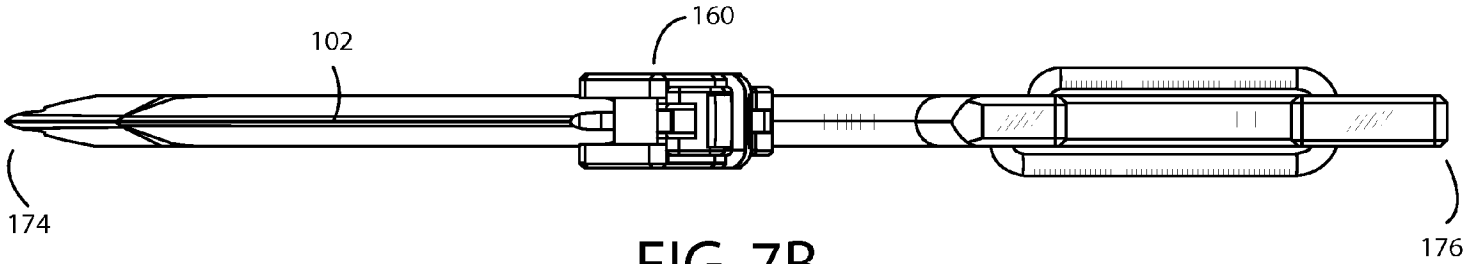
FIG. 7B illustrates a bottom perspective embodiment of the invention in the half open position.
Figure 7C:
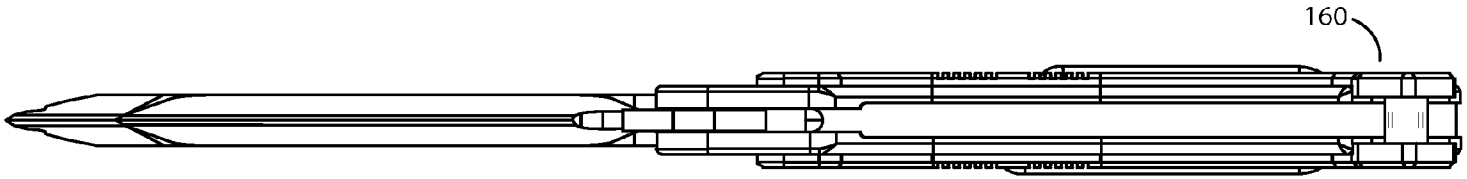
FIG. 7C illustrates a bottom perspective embodiment of the invention in the open position.

FIG. 7A illustrates a bottom perspective embodiment of the invention in the closed position, FIG. 7B illustrates a bottom perspective embodiment of the invention in the half open position, and FIG. 7C illustrates a bottom perspective embodiment of the invention in the open position. As shown in FIGS. 7A-7C, one or more embodiments of the invention may include the survival knife 100 with the cutting edge 102 of the blade, the guard 160, the front portion or tip 174 of the blade, and the rear portion 176 of the blade 101. By way of one or more embodiments, in a first position, the closed position, the guard 160 may be located about the front portion or tip 174 of the blade 101 as shown in FIG. 7A in order to cover the cutting edge of the blade. In at least one embodiment, in the half open position, the guard 160 may be located about the center portion the blade 101, between said front portion or tip 174 and said rear portion 176, as shown in FIG. 7B. According to one or more embodiments, in a second position, the guard 160 may be located about the rear portion 176, of the blade 101 as shown in FIG. 7C, to form the bottom half of the handle.

Figure 8C:
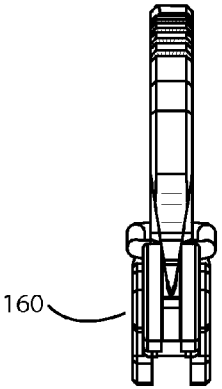
FIG. 8C illustrates a front perspective embodiment of the invention in the open position.
Figure 8B:
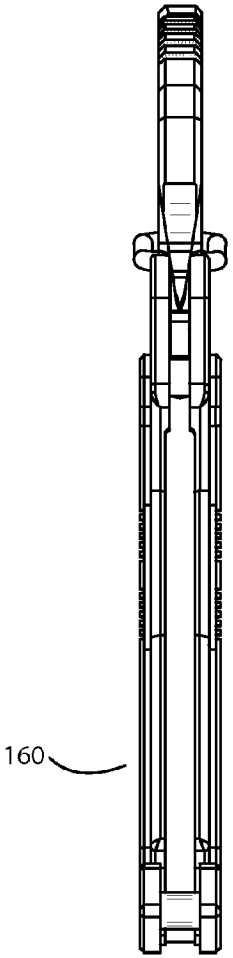
FIG. 8B illustrates a front perspective embodiment of the invention in the half open position.
Figure 8A:
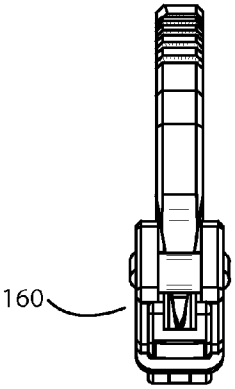
FIG. 8A illustrates a front perspective embodiment of the invention in the closed position.

FIG. 8A illustrates a front perspective embodiment of the invention in the closed position, FIG. 8B illustrates a front perspective embodiment of the invention in the half open position, and FIG. 8C illustrates a front perspective embodiment of the invention in the open position. As shown in FIG. 8A-8C, one or more embodiments of the invention may include the survival knife 100 with the front portion or tip shown enclosed by guard 160. By way of one or more embodiments, the guard 160 may move from a closed position about the front portion or tip as shown in FIG. 8A, to a half open position as shown in FIG. 8B, and/or to an open position as shown in FIG. 8C about the rear portion so that the blade is uncovered.

Figure 9C:
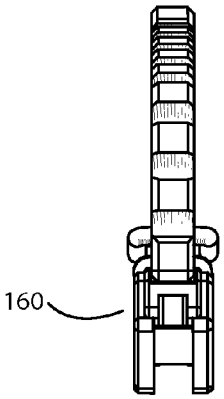
FIG. 9C illustrates a back perspective embodiment of the invention in the open position.
Figure 9B:
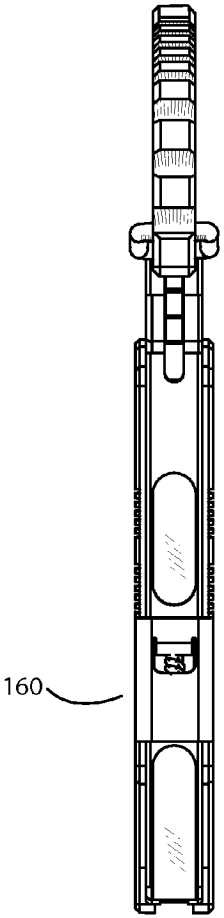
FIG. 9B illustrates a back perspective embodiment of the invention in the half open position.
Figure 9A:
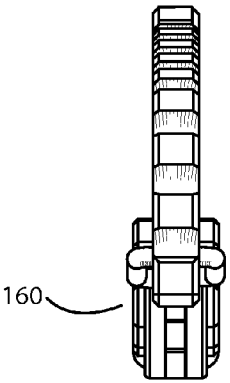
FIG. 9A illustrates a back perspective embodiment of the invention in the closed position.

FIG. 9A illustrates a back perspective embodiment of the invention in the closed position, FIG. 9B illustrates a back perspective embodiment of the invention in the half open position, and FIG. 9C illustrates a back perspective embodiment of the invention in the open position. As shown in FIGS. 9A-9C, one or more embodiments of the invention may include the survival knife 100 with the rear portion. By way of one or more embodiments, the guard 160 may move from a closed position about the front portion or tip 174 (not shown) as shown in FIG. 9A, to a half open position as shown in FIG. 9B, and/or to an open position as shown in FIG. 9C about the rear portion 176.

Figure 11:
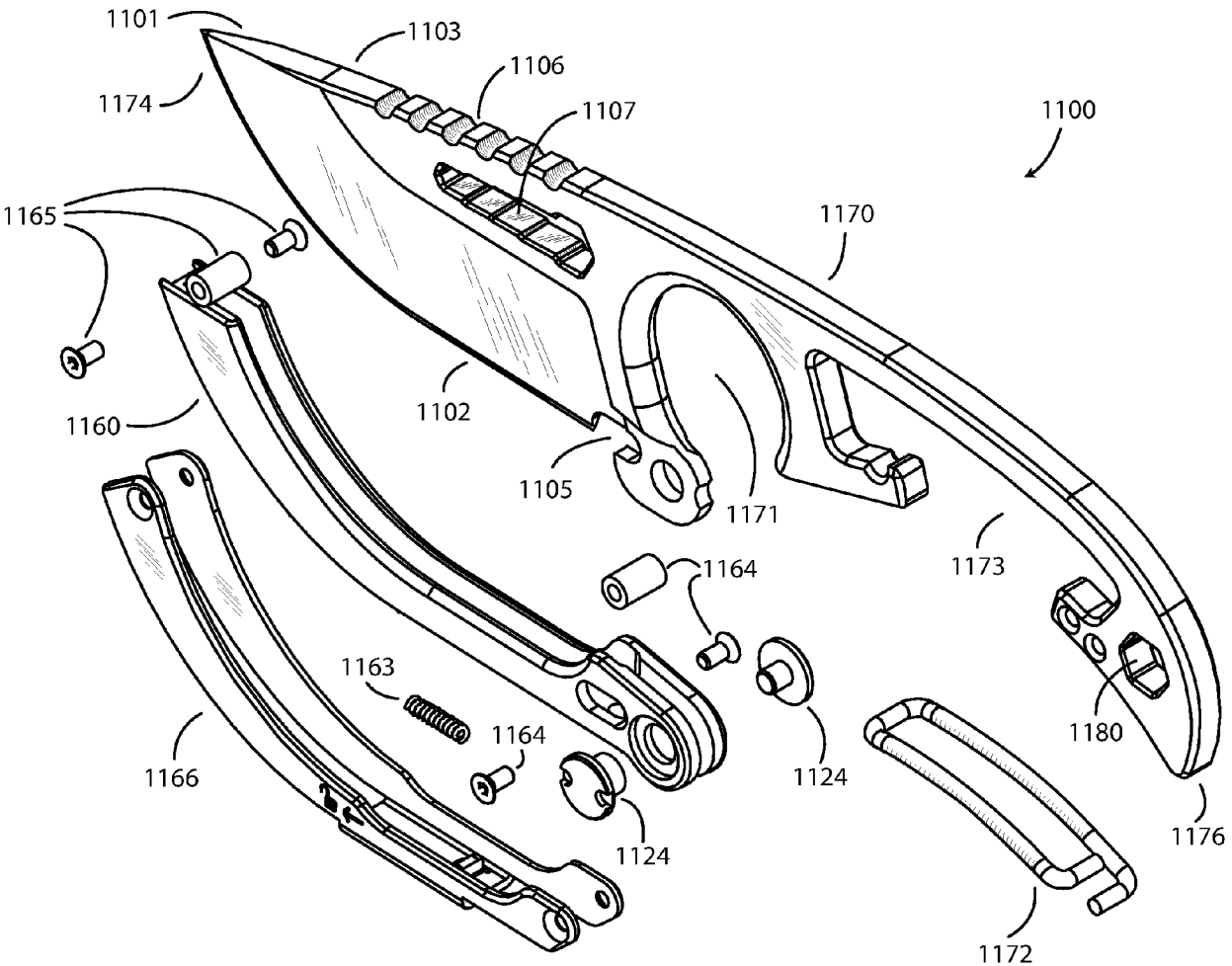
FIG. 11 illustrates an exploded view of the invention with a skinner blade according to one or more embodiments.

By way of one or more embodiments of the invention, the blade 101 of the survival knife 100 may include different shapes and sizes, such that the survival knife 100 may be used as one or more of a cutter, as shown in FIG. 10, and a skinner, as shown in FIG. 11.

FIG. 10 illustrates an exploded view of the invention with a straight blade or cutter blade according to one or more embodiments. In at least one embodiment of the invention, the survival knife 100 may be a cutter with a cutter blade 101, and may include one or more of the elements discussed previously regarding FIGS. 1-9. As shown in FIG. 10, in the exploded view of the survival knife 100/cutter, one or more embodiments include one or more of the blade 101, the front portion or tip 174, the rear portion 176, the cutting edge 102, the non-cutting edge 103, the jimping 106, the wrench tool 107 and the body 170 that may be coupled with the blade 101. By way of at least one embodiment, the knife 100 may include one or more of the carabiner 173, the gate 172, such as the wire gate, and the guard 160 that may be coupled with the body 170.

In one or more embodiments, the body 170 may include the rear portion 176 and may form a first half of a handle that may engage a palm of a user. As shown in FIG. 10, in at least one embodiment, the body 170 may include one or more of the lock cam pin indentation 105, and the lock 161. In one or more embodiments, the lock 161 may include one or more of the lock cam pin 164, the lock pin 165, the lock arm 166 coupled with the lock cam pin 164 and the lock pin 165, and the spring 163 coupled with the guard and lock in any manner, for example by attaching one end of the spring to the guard and the other end to the lock. In at least one embodiment, the spring 163 may provide increased force as the lock 161 is extended from the guard 160, i.e., moves laterally against the spring force.

In at least one embodiment, (see also FIG. 1), the blade 101 may include the jimping 106, such as at least two slots, and the finger hole 171, and the guard 160 may include one or more of the curved surface that may provide an ergonomic grip, or lock grip, 167, to the fingers of the user, and the pivot bolt 124. In one or more embodiments, the blade 101 may include the wrench tool 107 that may enable rotation of multiple sizes of nuts. By way of one or more embodiments, the blade 101 may include the optional indent 177 that may engage the lock pin 165, in other embodiments the lock pin may engage the top portion of the blade without an indent.

FIG. 11 illustrates an exploded view of the invention with a curved or skinner blade according to one or more embodiments. In at least one embodiment of the invention, the survival knife 100 may be a skinner, 1100, with a skinner blade 1101, and may include one or more of the elements discussed previously regarding FIGS. 1-10. As shown in FIG. 11, in at least one embodiment, the survival knife 1100 may include the blade 1101, a front portion or tip 1174 of the blade 1101 and body 1170, a rear portion 1176 of the blade 1101 and body 1170, two substantially flat faces, and a top edge. By way of one or more embodiments, the blade 1101 may include a cutting edge 1102 on a first side of the blade 1101 where the two substantially flat faces may meet, and a non-cutting edge 1103, wherein the top edge may be located on a second side of the blade 1101 opposite the cutting edge 1102. In embodiments, the top may be flat and may be at least 3/16 of an inch wide.

According to embodiments of the invention, the survival knife 1100 may include one or more of a body 1170 that may be coupled with the blade 1101, and a guard 1160 that may be coupled with the body 1170. In one or more embodiments, the body 1170 may include the rear portion 1176 and may form a first half of a handle that may engage a palm of a user. In embodiments of the invention, the guard 1160 may cover the cutting edge 1102 in a first position, and may form a second half of the handle. As such, the guard 1160 may engage fingers of the user in a second position on an opposing side of the first half of the handle.

By way of one or more embodiments, the guard 1160 may be rotationally coupled with the body 1170 at approximately half way between the front portion or tip 1174, and the rear portion 1176 of the body 1170. The survival knife 1100, in at least one embodiment, may be in the half open position, wherein the guard 1160 may be located at an angle less than 360 degrees away from the front portion or tip 1174 and/or the rear portion 1176. For example, the guard 1160 may be located at a half open position that is almost substantially perpendicular to the cutting edge 1102. In at least one embodiment, the body 1170 may include one or more of a cam (not shown), a lock cam pin indentation 1105, and a lock (not shown). In one or more embodiments, the lock may include one or more of a lock cam pin 1164, a lock pin 1165, a lock arm 1166 coupled with the lock cam pin 1164 and the lock pin 1165, and a spring 1163 that may be coupled with the guard 1160 and the lock. In at least one embodiment, the spring 1163 may provide increased force as the lock is extended from the guard 1160. In embodiments of the invention, the cam may move the lock cam pin 1164, the lock arm 1166 and the lock pin 1165 toward the front portion 1174 of the blade 1101, and/or may move the lock pin 1165 past the front portion 1174 of the blade 1101 above the cutting edge 1102 as the guard 1160 is rotated into the first position to cover the cutting edge 1102 of the blade 1101. In one or more embodiments of the invention, the lock cam pin indentation 1105 may one or more of move the lock cam pin 1164, the lock arm 1166 and the lock pin 1165 toward the rear portion 1176 of the body 1170, as the lock cam pin 1164 enters the lock cam pin indentation 1105, and move the lock pin 1165 above the cutting edge 1102 to lock the lock pin 1165 against the front portion of the blade 1101. In at least one embodiment, the lock arm 1166 may move the lock cam pin 1164, the lock arm 1166, and the lock pin 1165 toward the front portion 1174 of the blade 1101, as the lock cam pin 1164 exits the lock cam pin indentation 1105. In embodiments of the invention, the lock arm 1166 may move the lock pin 1165 below the cutting edge 1102 to unlock the lock pin 1165 from against the front portion of the blade 1101, and enable the guard 1160 to rotate to the second position to form the second half of the handle.

The blade 1101, in at least one embodiment, may include jimping 1106 on the top edge of the blade 1101. In one or more embodiments, the body 1170 may include jimping 1106 on a portion of the first half of the handle formed by the body 1170. In one or more embodiments, the jimping 1106 may include slots on the top of the blade 1101 near the handle, and/or on the back of the body of the blade 1101, that may enable thumb contact with the blade 1101 that may provide better control of the knife 1100.

By way of one or more embodiments, the body 1170 may include a finger hole 1171, and the guard 1160 may include one or more of a curved surface that may provide an ergonomic grip, or lock grip (not shown), to the fingers of the user, and a pivot bolt 1124. In embodiments of the invention, the body 1170 may include a carabiner 1173 that may open and close via a gate 1172, such as a wire gate. In one or more embodiments, the blade 1101 may include a wrench tool 1107 that may enable rotation of multiple sizes of nuts. By way of one or more embodiments, the blade 1101 may include an optional indent (not shown) that may engage the lock pin 1165.

According to one or more embodiments, the survival knife 1100 with integrated moveable guard may include one or more hexagonal holes 1180 on the body 1170, of the same size and shape or of various sizes and shapes, to enable the knife 1100 to be used as an integrated tool, such as a hex nut tool for various hex nut sizes. In embodiments, the blade 1101 may include a single hexagonal hole 1180 to enable the blade 1101 to be used for a single hex nut size. As such, the one or more hexagonal holes 1180 enable the knife 1100 to be utilized as a hex nut wrench. The hex nut integrated tool, such as 1180, in one or more embodiments, may be located in the center of the blade 1101, in the front portion 1174 of the blade 1101, or at the rear portion 1176 of the body 1170 away from a front portion tip. As such, the integrated tool may be used when the knife 1100 is in the open, closed, or half open configuration. In one or more embodiments, the integrated tool, knife 1100 or blade 1101 may be magnetized to hold bits.

In at least one embodiment, the knife 1100, or the integrated tool, may include lashing points that may be located on the blade 1101. In embodiments of the invention, the lashing points may be located on the knife 1100 or blade 1101 that does not comprise strength. By way of one or more embodiments, the integrated tool, the one or more hexagonal holes, the jimping 106, or any combination thereof may be used to lash the knife 1100 to another object.

While the invention herein disclosed has been described by means of specific embodiments and applications thereof, numerous modifications and variations could be made thereto by those skilled in the art without departing from the scope of the invention set forth in the claims.

What is claimed is:

1. A survival knife with an integrated moveable guard comprising:

a blade having a front portion and two substantially flat faces and a top edge wherein the blade comprises a cutting edge on a first side of the blade where the two substantially flat faces meet wherein said top edge is located on a second side of the blade opposite the cutting edge;

a body coupled with said blade wherein said body comprises a rear portion, and wherein said body is configured to form a first half of a handle configured to engage a palm of a user;

a guard coupled with said body and configured to
cover said cutting edge in a first position, and
form a second half of said handle configured to engage fingers of the user in a second position on an opposing side of said first half of said handle;
wherein said guard is rotationally coupled with said body at approximately half way between said front portion of said blade and said rear portion of said body; and,
wherein said body further comprises
a cam;
a lock cam pin indentation;
and further comprising a lock comprising
a lock cam pin;
a lock pin;
a lock arm coupled with said lock cam pin and said lock pin; and,
a spring coupled with said guard and said lock and configured to provide increase force as said lock is extended from said guard;
wherein said cam is configured to
move said lock cam pin and said lock arm and said lock pin toward said front portion of said blade, and
move said lock pin past said front portion of said blade above said cutting edge as said guard is rotated into said first position to cover said cutting edge of said blade;
wherein said lock cam pin indentation is configured to
move said lock cam pin, said lock arm and said lock pin toward said rear portion of said body as the lock cam pin enters the lock cam pin indentation, and
move said lock pin above said cutting edge to lock said lock pin against the front portion of the blade;
wherein said lock arm is configured to
move said lock cam pin, said lock arm, and said lock pin toward said front portion of said blade as the lock cam pin exits the lock cam pin indentation, and
move said lock pin below said cutting edge to unlock said lock pin from against the front portion of the blade and enable the guard to rotate to said second position to form said second half of said handle.

2. The survival knife with an integrated moveable guard of claim 1 wherein said blade comprises jimping on said top edge of said blade.

3. The survival knife with an integrated moveable guard of claim 1 wherein said body comprises jimping on a portion of the first half of the handle formed by said body.

4. The survival knife with an integrated moveable guard of claim 1 wherein said body comprises a finger hole.

5. The survival knife with integrated moveable guard of claim 1 wherein said guard comprises a curved surface configured to provide an ergonomic grip to said fingers of said user.

6. The survival knife with an integrated moveable guard of claim 1 wherein said body comprises a carabiner that is configured to open and close via a gate.

7. The survival knife with an integrated moveable guard of claim 1 wherein said blade comprises a wrench tool to enable rotation of multiple sizes of nuts.

8. The survival knife with an integrated moveable guard of claim 1 wherein said top edge is flat and at least 3/16 of an inch wide.

9. The survival knife with an integrated moveable guard of claim 1 wherein said blade comprises an optional indent configured to engage said lock pin.

10. A survival knife with an integrated moveable guard comprising:
a blade having a front portion and two substantially flat faces and a top edge wherein the blade comprises
a cutting edge on a first side of the blade where the two substantially flat faces meet wherein said top edge is located on a second side of the blade opposite the cutting edge;
a body coupled with said blade wherein said body comprises a rear portion and wherein said body is configured to
form a first half of a handle configured to engage a palm of a user;
a guard coupled with said body and configured to
cover said cutting edge in a first position,
form a second half of said handle configured to engage fingers of the user in a second position on an opposing side of said first half of said handle, and
wherein said guard comprises a curved surface configured to provide an ergonomic grip to said fingers of said user;
wherein said guard is rotationally coupled with said body at approximately half way between said front portion of said blade and said rear portion of said body; and
wherein said body further comprises
a cam;
a lock cam pin indentation;
and further comprising a lock comprising
a lock cam pin;
a lock pin;
a lock arm coupled with said lock cam pin and said lock pin; and,
a spring coupled with said guard and said lock and configured to provide increase force as said lock is extended from said guard;
wherein said blade further comprises an optional indent configured to engage said lock pin;
wherein said cam is configured to
move said lock cam pin and said lock arm and said lock pin toward said front portion of said blade, and
move said lock pin past said front portion of said blade above said cutting edge as said guard is rotated into said first position to cover said cutting edge of said blade;
wherein said lock cam pin indentation is configured to
move said lock cam pin and said lock arm and said lock pin toward said rear portion of said body as the lock cam pin enters the lock cam pin indentation, and
move said lock pin above said cutting edge to lock said lock pin against the front portion of the blade; and,
wherein said lock arm is configured to
move said lock cam pin, said lock arm, and said lock pin toward said front portion of said blade as the lock cam pin exits the lock cam pin indentation, and
move said lock pin below said cutting edge to unlock said lock pin from against the front portion of the blade and enable the guard to rotate to said second position to form said second half of said handle.

11. The survival knife with an integrated moveable guard of claim 10 wherein said blade comprises jimping on said top edge of said blade.

12. The survival knife with an integrated moveable guard of claim 10 wherein said body comprises jimping on a portion of the first half of the handle formed by said body.

13. The survival knife with an integrated moveable guard of claim 10 wherein said body comprises a finger hole.

14. The survival knife with an integrated moveable guard of claim 10 wherein said body comprises a carabiner that is configured to open and close via a gate.

15. The survival knife with an integrated moveable guard of claim 10 wherein said blade comprises a wrench tool to enable rotation of multiple sizes of nuts.

16. The survival knife with an integrated moveable guard of claim 10 wherein said top edge is flat and at least 3/16 of an inch wide.

17. A survival knife with an integrated moveable guard comprising:

a blade having a front portion and two substantially flat faces and a top edge wherein the blade comprises a cutting edge on a first side of the blade where the two substantially flat faces meet wherein said top edge is located on a second side of the blade opposite the cutting edge, and a wrench tool to enable rotation of multiple sizes of nuts;

a body coupled with said blade wherein said body comprises a rear portion and wherein said body is configured to form a first half of a handle configured to engage a palm of a user;

a guard coupled with said body and configured to cover said cutting edge in a first position, and form a second half of said handle configured to engage fingers of the user in a second position on an opposing side of said first half of said handle;

wherein said guard is rotationally coupled with said body at approximately half way between said front portion of said blade and said rear portion of said body; and wherein said body further comprises a carabiner that is configured to open and close via a gate;

a cam;

a lock cam pin indentation;

and further comprising a lock comprising a lock cam pin;

a lock pin;

a lock arm coupled with said lock cam pin and said lock pin; and, a spring coupled with said guard and said lock and configured to provide increase force as said lock is extended from said guard;

wherein said blade further comprises an optional indent configured to engage said lock pin;

wherein said cam is configured to move said lock cam pin and said lock arm and said lock pin toward said front portion of said blade, and move said lock pin past said front portion of said blade above said cutting edge as said guard is rotated into said first position to cover said cutting edge of said blade;

wherein said lock cam pin indentation is configured to move said lock cam pin and said lock arm and said lock pin toward said rear portion of said body as the lock cam pin enters the lock cam pin indentation, and move said lock pin above said cutting edge to lock said lock pin against the front portion of the blade; and, wherein said lock arm is configured to move said lock cam pin, said lock arm, and said lock pin toward said front portion of said blade as the lock cam pin exits the lock cam pin indentation, and move said lock pin below said cutting edge to unlock said lock pin from against the front portion of the blade and enable the guard to rotate to said second position to form said second half of said handle.

* * * * *